US007881652B2

(12) United States Patent
Edwards et al.

(10) Patent No.: US 7,881,652 B2
(45) Date of Patent: Feb. 1, 2011

(54) MODULAR PRINTER AND SCANNER ADF DUPLEXER FEEDPATH INCLUDING SECOND TRAY

(75) Inventors: Mark J. Edwards, Lexington, KY (US); Brian K. Owens, Lexington, KY (US); Gregory P. Washnock, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 858 days.

(21) Appl. No.: 11/170,929

(22) Filed: Jun. 30, 2005

(65) Prior Publication Data

US 2007/0003339 A1 Jan. 4, 2007

(51) Int. Cl.
*G03G 15/00* (2006.01)

(52) U.S. Cl. ..... 399/364; 399/374; 399/401; 271/3.19; 271/225; 400/691; 400/692; 400/693

(58) Field of Classification Search ..... 399/364, 399/374, 401; 400/691, 692, 693; 271/3.19, 271/225
See application file for complete search history.

(56) References Cited

U.S. PATENT DOCUMENTS 4,218,128 A * 8/1980 Satomi et al. ..... 399/85
4,456,238 A 6/1984 Mizuma
5,004,217 A 4/1991 Kano et al.
5,095,370 A 3/1992 Takada et al.
5,298,937 A * 3/1994 Telle ..... 355/23
5,517,332 A 5/1996 Barry et al.
5,662,320 A 9/1997 Fujiwara et al.
5,751,448 A 5/1998 Kim et al.
5,823,522 A 10/1998 Fujiwara et al.
5,897,110 A 4/1999 Fujiwara
5,982,512 A 11/1999 Kim
6,215,970 B1 4/2001 Yoshikawa et al.
6,463,256 B2 * 10/2002 Blackman ..... 399/401
6,507,418 B1 1/2003 Chen
6,728,012 B2 * 4/2004 Bacher et al. ..... 358/498
6,864,999 B1 3/2005 Fujimoto et al.
7,128,317 B2 * 10/2006 Johnson et al. ..... 271/121

FOREIGN PATENT DOCUMENTS

JP 2004015652 A * 1/2004

* cited by examiner

*Primary Examiner*—Judy Nguyen
*Assistant Examiner*—Andy L Pham
(74) *Attorney, Agent, or Firm*—John Victor Pezdek

(57) ABSTRACT

A modular duplexing housing for an all-in-one device which may be added at a final stage of assembly in order to convert a simplex printing unit into a duplex printing and duplex ADF scanning unit. The modular duplexing unit includes a duplexing feedpath which may be positioned for feeding communication with a simplex printing feedpath in the all-in-one device. The modular duplexing unit may also comprise a secondary input tray in feeding communication with the simplex printing unit and duplexing ADF scanning unit.

18 Claims, 9 Drawing Sheets

MODULAR PRINTER AND SCANNER ADF DUPLEXER FEEDPATH INCLUDING SECOND TRAY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to scanners and scanning methods, and more particularly to a duplexing printer and scanner auto-document feeder module.

2. Description of the Related Art

All-in-one machines typically perform functions such as printing, scanning, copying, and faxing in either a stand alone fashion or in conjunction with a personal computer and define a growing market for peripheral devices. These devices eliminate clutter in a business or home office by combining the desirable functionality of various machines into a single unit, while maintaining an affordable cost. Various all-in-one machines currently in the marketplace use thermal inkjet technology as a means for printing received fax documents, original documents, and copied or scanned images or text. Thermal inkjet printing devices utilize consumable inkjet cartridges in fluid communication with a printhead to record text and images on a print media. The printhead typically moves on a carriage relative to the media path and a control system activates the printhead to selectively eject ink droplets onto the print media.

Scanners are used to scan a target image and create scanned image data which can be displayed on a computer monitor, which can be used by a computer program, which can be printed, which can be faxed, etc. Scanned data may be saved to memory or a magnetic or optical drive, or other fixed or removable memory device. Scanning devices may be packaged in a stand-alone housing or as part of the all-in-one device, as described herein, including a printing module to perform scanning as well as standard copying functions.

Scanners typically include a housing aperture defined by an edge wherein a platen is located. A target document is positioned on the platen for scanning of the text or image by a scanbar. Depending on the positioning of the scanbar relative to the platen, the platen may be transparent where the scanbar is beneath the platen or may be solid where the scanbar is above the platen. For a typical flatbed scanner, the scanbar will be below the platen, which will have a transparent section to allow for the scan operation.

The scanner may also include an auto-document feeder (ADF) to automatically and sequentially feed a plurality of documents to a scan module. The automatic document feeder typically comprises a feed tray and an input device which feeds a single sheet from the stack of media on the feed tray into the automatic document feeder media path. The single sheet of media passes a reading position where the media is illuminated and image data is created by the scanbar representing images on the media. The media then passes from the auto-document feeder to a stacking tray where the media remains until all of the media from the feed tray has been scanned and is removed from the stacking tray at the output side of the auto-document feeder.

Generally, most auto-document feeders are single-side or simplex media feeding devices. However, many end-users desire the ability to perform double-sided or duplex operations. To perform a duplex scan, the media must be turned which may be performed manually by the user. Alternatively, prior art patents have taught various mechanical means for reversing media sides and performing double-sided or duplex scanning. According to one method of duplex scanning the auto-document feeder comprises first and second image sensors to scan first and second sides of the media, respectively. However, the problem with these devices is that the two image sensors require large amounts of space and therefore make the equipment footprint much larger. This is not suitable for many applications, especially home-office equipment or small office equipment and further increases the costs of the device which is also undesirable.

Another problem with auto-document feeding scanners is that the auto-document feed portion is typically located on the upper portion of the device. Due to the large size of the image sensing equipment, or dual units for duplexing as previously described, the duplexing auto-document feeders extend from the upper portion of the office peripheral and have an obtrusive design architecture. In particular, the auto-document feeders typically add to the overall height of the machine which is undesirable. Further, such architecture results in difficulty incorporating an overall machine appearance scheme.

In addition to the previously indicated problems, one of ordinary skill in the art will recognize that the prior art descriptions herein require separate document handling systems for the auto-document feeding scanner and a printer component. This is disadvantageous because multiple parts are required to perform the same function of document handling. This also leads to added expense for the all-in-one device.

Given the foregoing deficiencies, it will be appreciated that an improved apparatus for scanning is needed which utilizes a modular duplexer to convert a simplex printer to a duplex scanner and duplex printer and which further has a smaller footprint with lower height requirements than state of the art duplexing auto-document feeding units.

SUMMARY OF THE INVENTION

According to a first embodiment, a modular duplexing unit includes an auto-document feeder for an all-in-one device including an all-in-one device having a housing and a simplex feedpath within the housing, a duplexing module connectable to the primary housing, the duplexing module having a duplex feedpath and a scanner, wherein the all-in-one device function is converted from simplex printing to duplex printing and duplex auto-document feed scanning.

The duplexing feedpath is in feeding communication with the simplex feedpath. The duplexing module has a geartrain. The geartrain engages a gear in the all-in-one device. The modular duplexing unit further comprises an electronic connector for electrical communication with the primary housing. The all-in-one device further comprises an input tray and an output tray in feeding communication with the simplex and duplex feedpaths. The modular duplexing unit further comprises a secondary input tray connected to the duplexing module.

According to a second embodiment, a modular duplexing feedpath unit includes an auto-document feed scanner for an all-in-one device, comprising a primary housing having a printing component and a printing feedpath, a duplexing auto-document feed scanner housing for connection with a primary housing, a duplexing feedpath defined within the duplexing auto-document feed scanner housing, the duplexing feedpath being in feeding communication with the printing component and the printing feedpath within the primary housing of the all-in-one device, an image sensor positioned in the duplexing auto-document feed scanner housing along the duplexing feedpath, at least one gear in the duplexing auto-document feed scanner housing meshing with at least one gear in the primary housing, an electrical connector in the duplexing auto-document feed scanner housing in electrical communication with an electrical connector in said primary housing.

The printing feedpath is a substantially C-shaped feedpath. The duplexing feedpath further comprising a recirculation path. The image sensor comprises a contact image sensor. The scanbar is disposed along an inner surface of the feedpath. The primary housing further comprises a rear aperture for positioning of the duplexing auto-document feed scanner housing. The duplexing auto-document feed scanner housing is connected through a surface of the primary housing other than an upper surface. The duplexing auto-document feed scanner housing includes a media tray.

According to a third embodiment, a modular duplexing unit for use with an all-in-one device comprises an all-in-one device having a primary housing with a receiving area, a printing feedpath in the primary housing, a modular housing connected to the primary housing through the receiving area, the modular housing having a duplexing feedpath, an image sensor disposed along the duplexing feedpath and in optical communication with the duplexing feedpath, the duplexing feedpath in communication with the printing feedpath when the modular housing is connected through the receiving area. The modular duplexing housing comprises a media stacking tray for providing documents to the duplexing feedpath.

According to a final embodiment, a modular duplexing unit for a scanner device comprises an all-in-one device having a simplex feedpath, a simplex printing component and at least one input tray and at least one output tray, a duplexing feedpath in feeding communication with the simplex feedpath and a scanbar located along the duplexing feedpath. The modular duplexing unit further comprises a secondary input tray in feeding communication with at least one of the simplex feedpath and the duplex feedpath. The at least one input tray comprises first and second input trays for placement of print media and target media, respectively.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
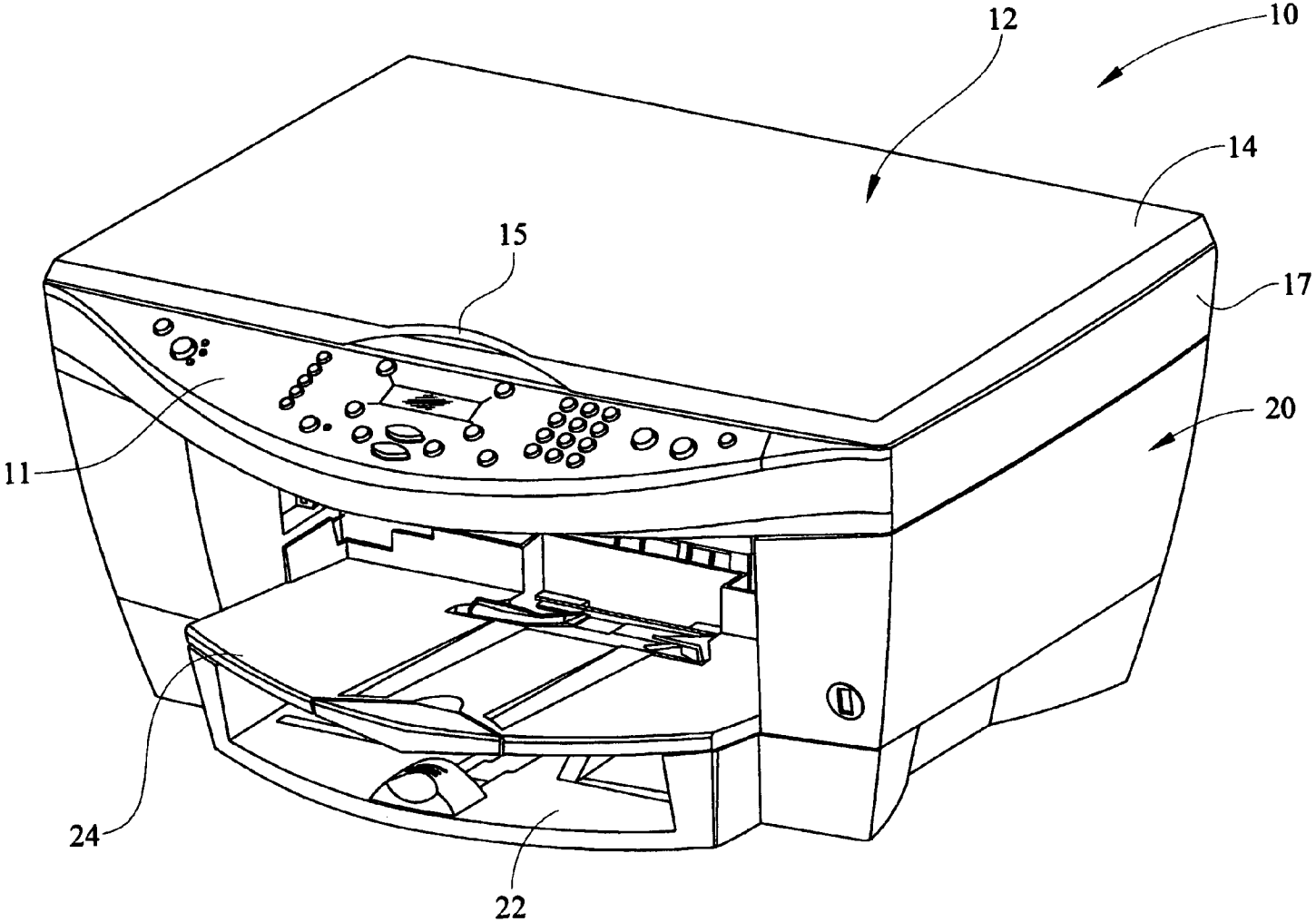
FIG. 1 is a front perspective view of one embodiment of an all-in-one device of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output.

Referring now in detail to the drawings, wherein like numerals indicate like elements throughout the several views, in FIGS. 1-9 various aspects of a duplexing module which comprises a duplex media path and a scanbar are shown. The apparatus provides various functions including minimizing cost and size of the duplexing auto-document feeder as well as allowing the device to perform duplex printing.

Referring initially to FIG. 1, an all-in-one device 10 is shown having a scanner portion 12 and a printer portion or component, generally depicted by a housing 20. The all-in-one device 10 is shown and described herein, however one of ordinary skill in the art will understand upon reading of the instant specification that the present invention may be utilized with a stand alone printer, copier, auto-document feed scanner, or other device having a media feed system. The all-in-one device 10, which can be operated as a PC peripheral device, further comprises a control panel 11 having a plurality of buttons for making selections. The control panel 11 may include a graphics display to provide a user with menus, choices or errors occurring with the system.

The printer portion 20 may include various types of printing mechanisms including a laser printing mechanism or an ink-jet printing mechanism. These are known in the prior art and therefore will not be described herein. Extending from the printer portion 20 are a feed or input tray 22 and an exit or output tray 24 disposed above the input tray 22. The input tray 22 and exit tray 24 are in feeding communication with the printing portion 20 to provide media to the printing portion 20.

Referring still to FIG. 1, a flat bed scanner 12 includes a scanner lid 14 which is hingedly connected to and covering a scanner bed 17. Beneath the scanner lid 14 and within the scanner bed 17 may be a transparent platen for placement and support of target or original media for manually scanning. Along a front edge of the lid 14 is a handle 15 for opening of the lid 14 and placement of the target document on the transparent platen (not shown).

Beneath the scanning platen is an optical scanning unit having a plurality of parts which are not shown but are generally described herein. The scanning unit may comprise a scanning motor and drive which connects the scanning motor and a scanbar. The scanbar is driven bi-directionally along a scanning axis extending in the longer dimension of the scanner bed 17. At least one guide bar may be disposed within the scanner bed 17 and may extend in the direction of the scanning axis to guide the scanning bar along the scanning axis. The scanbar moves along the at least one guide bar within the scanner bed 17 beneath the platen. For example, the scanbar may be moved by gear drive, belt drive, screw drive, pulley means, or the like. The scanbar has a length which extends in the shorter dimension of the scanning bed. Thus, the scanbar extends across one dimension and moves in a perpendicular dimension to scan an entire surface area of the platen during flatbed scanning. Alternatively, the scanbar may extend across the longer dimension of the scanner bed and move in the shorter direction.

The scanbar may include a lamp, an image sensor, and a mirror therein for obtaining a scanned image from a document. The image sensor may be an optical reduction type image sensor or a contact image sensor (CIS) as is known in the art. In either event, the image sensor then determines the image and sends data representing the image to onboard memory, a network drive, or a PC or server housing, a hard disk drive or an optical disk drive such as a CD-R, CD-RW, or DVD-R/RW. Alternatively, the original document may be scanned by the optical scanning component and a copy printed from the printer portion 20 in the case of the all-in-one device 10. The scanbar is generally either an optical reduction type using a combination of lens, mirror and a CCD (Charge Coupled Device) array or CIS array. The CCD array is a collection of tiny, light-sensitive diodes, which convert photons into electrons. These diodes are called photosites—the brighter the light that hits a single photosite, the greater the electrical charge that will accumulate at that site. The image of the document that is scanned using a light source such as a fluorescent bulb reaches the CCD array through a series of mirrors, filters and lenses. The exact configuration of these components will depend on the model of scanner. Some optical reduction scanners use a three pass scanning method. Each pass uses a different color filter (red, green or blue) between the lens and CCD array. After the three passes are completed, the scanner software assembles the three filtered images into a single full-color image. Most optical reduction scanners use the single pass method. The lens splits the image into three smaller versions of the original. Each smaller version passes through a color filter (either red, green or blue) onto a discrete section of the CCD array. The scanner software combines the data from the three parts of the CCD array into a single full-color image.

In general, for inexpensive flatbed scanners CIS are used. The CIS scanbar replaces the CCD array, mirrors, filters, lamp and lens with an array of red, green and blue light emitting diodes (LEDs) and a corresponding array of phototransistors. The image sensor array consisting of 600, 1200, 2400 or 4800 phototransistors per inch (depending on resolution) spans the width of the scan area and is placed very close to the glass plate upon which rests the image to be scanned. Another version of the CIS uses a single set of red, green and blue LEDs in combination with light pipes to provide illumination of the material to be scanned. Color scanning is done by illuminating each color type of LED separately and then combining the three scans. According to the present exemplary embodiment, an optical reduction type scanbar may be utilized for the flat bed scanning function since the optical reduction image sensor includes a longer focal length which is preferred for photos, drawings, and other three-dimensional images, rather than two dimensional images, such as text. Further, a CIS scanbar may be utilized for the ADF scanning because of its small size and suitability in an ADF.

Figure 2:
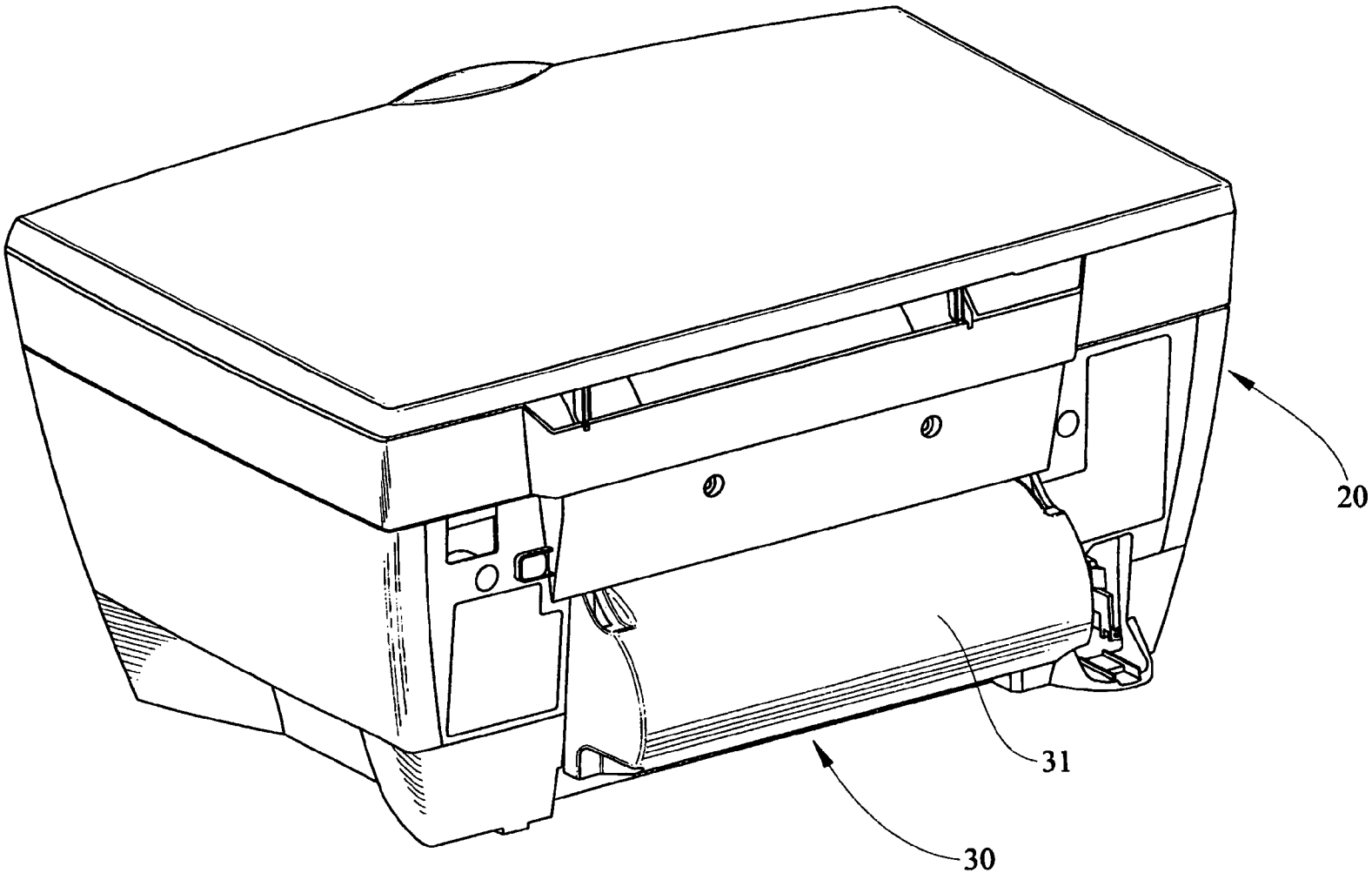
FIG. 2 is a rear perspective view of the all-in-one device of FIG. 1 depicting the duplexing auto-document feed scanning module.

Referring now to FIG. 2 a duplexer module 30, represented by cover set 31, extends from the rear of housing 20. The duplexer 30 is modular in design so that it may be added to an existing simplex all-in-one device to convert a simplex feedpath to a duplex capable unit. The cover set or auxiliary housing 31 is substantially C-shaped and covering the duplexer module 30 and thus defines a housing for a duplexer module 30. According to the exemplary embodiment, the duplexer 30 is slidably connected to a receiving area of the housing 20, whereby gear engagement and electrical communication are established between the module 30 and the primary housing of the all-in-one device. Further, by adding the duplexer module 30 to the primary housing 20, a feedpath 40 (FIG. 4) within duplexer 30 is placed in feeding communication with the portion of feedpath 40 within the primary housing 20. As a result, the duplexer module 30 is placed in feeding communication with the media trays 22,24 (FIG. 1) and allows for duplex printing as well as duplex scanning (both described further herein) by adding the module 30 to an all-in-one housing 20.

Figure 3:
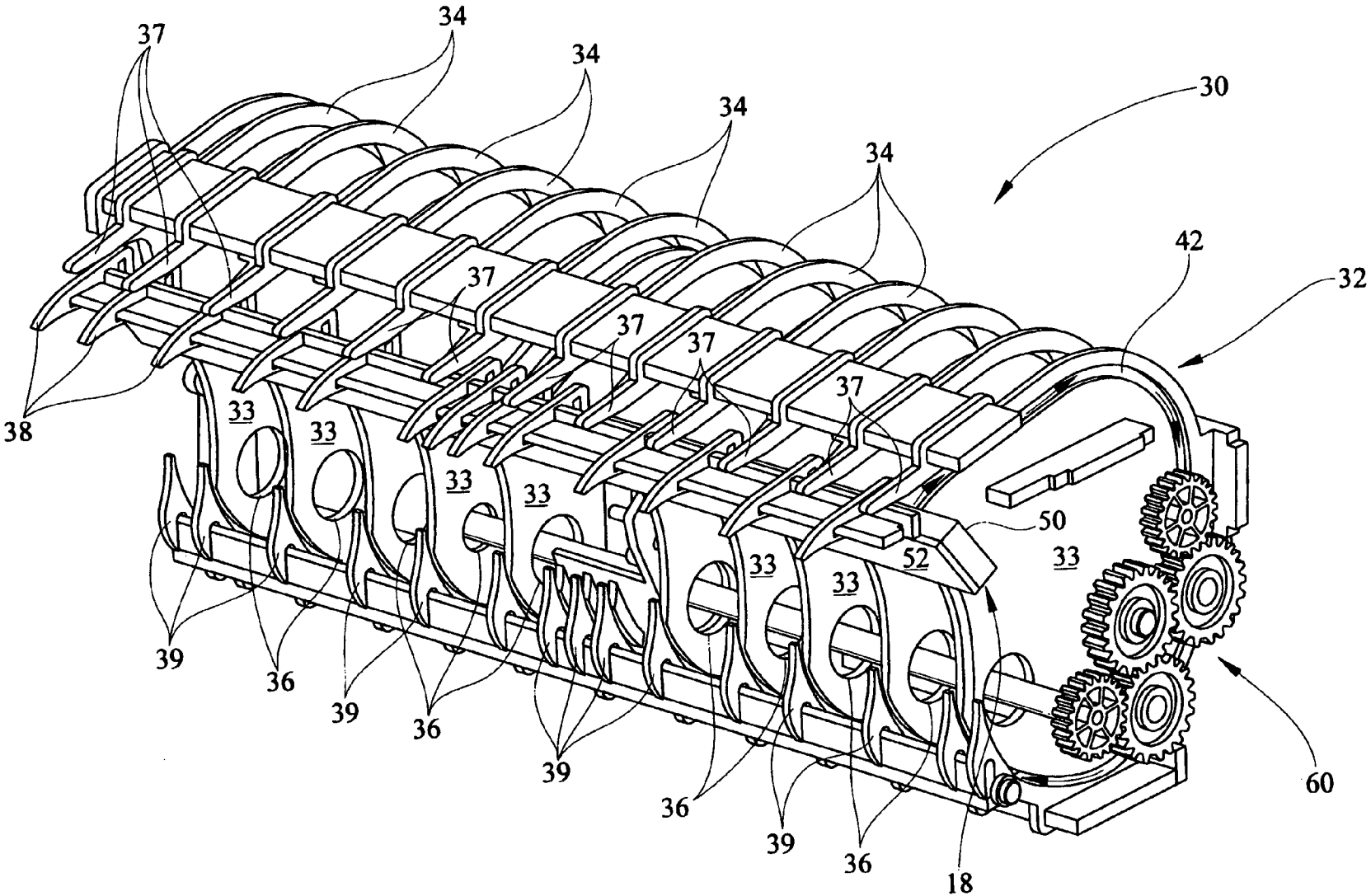
FIG. 3 is a perspective view of the duplexing auto-document feeding scanner with the cover set removed.

Referring now to FIG. 3, the exemplary duplexer module 30 further comprises an ADF scanner 18 therein. The ADF scanner 18, located in the duplexer module 30, is designed to scan stacks of documents which are normally sized, for example letter, legal, or A4, and suited for automatic feeding. The ADF scanner 18 comprises a scanbar 50, such as a CIS scanbar, and a transparent covering material 52, such as glass, described further herein.

The duplexer module 30 is formed of an outer frame 32 and an inner frame 33 defining a duplexing or recirculation path 42 therebetween. A feedpath 40 within the all-in-one device 10 comprises both a duplexing path 42 and a simplex path 44 thus providing the media feeding communication between the duplexer module 30 and the primary housing 20. The simplex path 44 is generally located within the primary housing 20, but when the duplexer module 30 is installed the simplex path 44 is partially defined between the module 30 and housing 20.

The outer frame 32 may be separate from or formed on the inner surface of the cover set 31 by a plurality of interconnected ribs 34. The ribs 34 have inner edges forming an upper outer surface of the duplexing feedpath 42. The guides or ribs 34 are substantially C-shaped and surrounding the inner frame 33 thereby forming the duplexing path 42 between the outer frame 32 and an inner frame 33. The recirculation or duplexing path 42 is also indicated by the plurality of arrows extending between the inner frame 33 and outer frame 32.

The inner frame 33 is also comprised of a plurality of interconnected ribs having edges which form an inner surface of the media feedpath 42 for the duplexing module 30. As depicted, each of the ribs of the inner frame 33 is substantially curvilinear in shape defining an inner limit of a duplexing feedpath 42. Together the outer frame 32 and the inner frame 33 form a recirculation or duplexing path 42 with an entrance and an exit. Also extending from the upper portion of the inner frame 33 are upper guides 38, described further herein, which direct media through the feedpath 40. As media travels through the duplexer module 30, the media moves across an upper surface of the duplexer module 30, downward along the ribs 34, to the bottom of the module 30 and upward along the front surface to define the recirculation or duplexing path 42. Further, each rib of the inner frame 33 comprises at least one aperture 36 through which at least one shaft extends.

A gear train 60 is depicted at an end of the duplexer unit 30. The gear train 60 is defined by a plurality of gears which utilize motor motion to move media through the simplex feedpath 44 (FIG. 4), the duplex feedpath 42, or both. The geartrain 60 engages at least one gear within the primary housing 20 of the all-in-one device to cause movement of media through duplexing feedpath 42.

As previously indicated, extending from the upper portion of the inner frame 33 are a plurality of upper guides 38. The upper guides 38 form a gate which is normally positioned to direct media to the upper portion of the duplexer module 30. The guides 38 are finger-like structures which are pivotally connected to the inner frame 33 and pivot to direct media moving through the feedpath 40 depending on whether the media is moving into the duplexing feedpath 42 or from the duplexing feedpath 42. The guides 38 are vertically offset from media guides 37 extending from the upper portion of the outer frame 32. This configuration creates a gap wherein media moves into the duplexing feedpath 42. Lower guides 39 are also located along the lower portion of the outer frame 32 to direct media upward as the media exits the space between the outer and inner frames 32,33 at a lower portion of the duplexing feedpath 42. The lower guides 39 direct the media from the recirculation path or loop 42 to the simplex portion 44 of the media feedpath 40 and further to the printer component or output tray 24 (FIG. 1). The lower guides 39 may also be pivotally mounted to form a gate. The lower guides 39 and upper guides 38 may be gravity gates or, alternatively, may be actuated by various means known to one skilled in the art.

Referring still to FIG. 3, the scanbar 50 is located along the upper portion of the inner frame 33. The exemplary scanbar 50 comprises a CIS. The scanbar 50 further comprises a glass cover 52 or other transparent material extending over the scanbar 50. The glass 52 inhibits contaminants such as dirt, paper dust, or the like from contaminating or damaging the image sensor device. The smaller size characteristics of the CIS, relative to an optical reduction-type image sensor, provides improved functionality in the ADF scanner 18 of the present invention. Due to the limited focal length of the CIS, a biasing device (not shown) may be utilized to bias the media toward the scanbar 50 as the target media passes the scanbar 50 operation.

Figure 4:
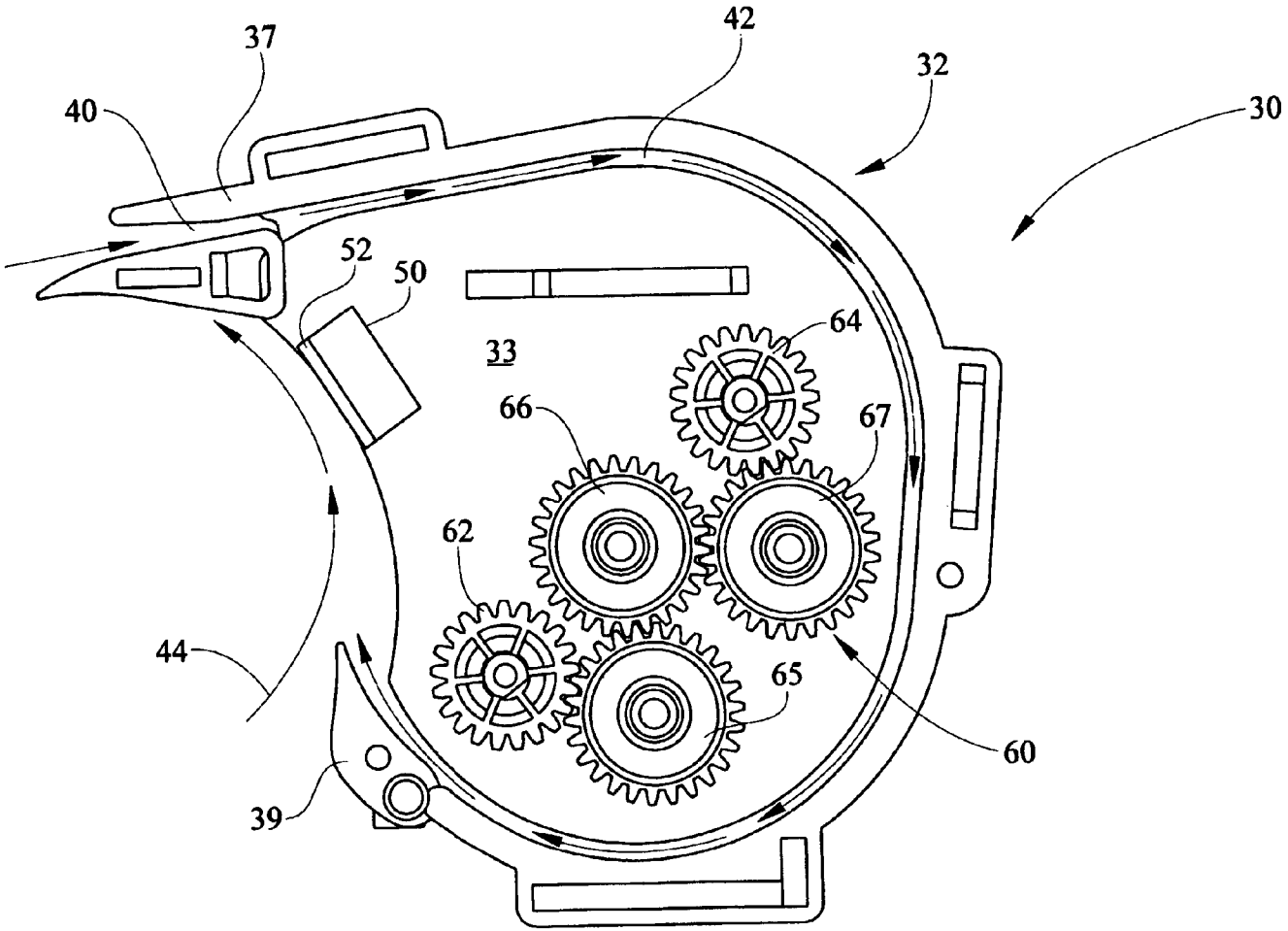
FIG. 4 is a side view of the duplexing auto-document feeding scanner of FIG. 3.

Referring now to FIG. 4, a side view of the duplexer module 30 is shown with the cover set 31 removed. The printing portion 21 (FIG. 5) and duplexer module 30, including ADF scanner 18, both share the common feedpath 40. As a result, the duplexer module 30 and ADF scanner 18 also are in feeding communication with the media trays 22,24 (FIG. 1). Further, such feeding communication between the housing 20 and duplexing module 30 allows the use of the feedpath 40 for both simplex and duplex printing as well as simplex and duplex scanning.

The duplexing module 30 may be slidably positioned in the housing 20 of the all-in-one device 10 so that the duplex feedpath 42 is in feeding communication with the simplex feedpath 44 of the housing 20. The duplexing path 42 is more clearly depicted between the outer frame 32 and inner frame 33. Further, the duplexing path 42 as well as the simplex path 44 define the feedpath 40 which serves both the printer portion 20 and the ADF scanner portion 18.

Figure 5:
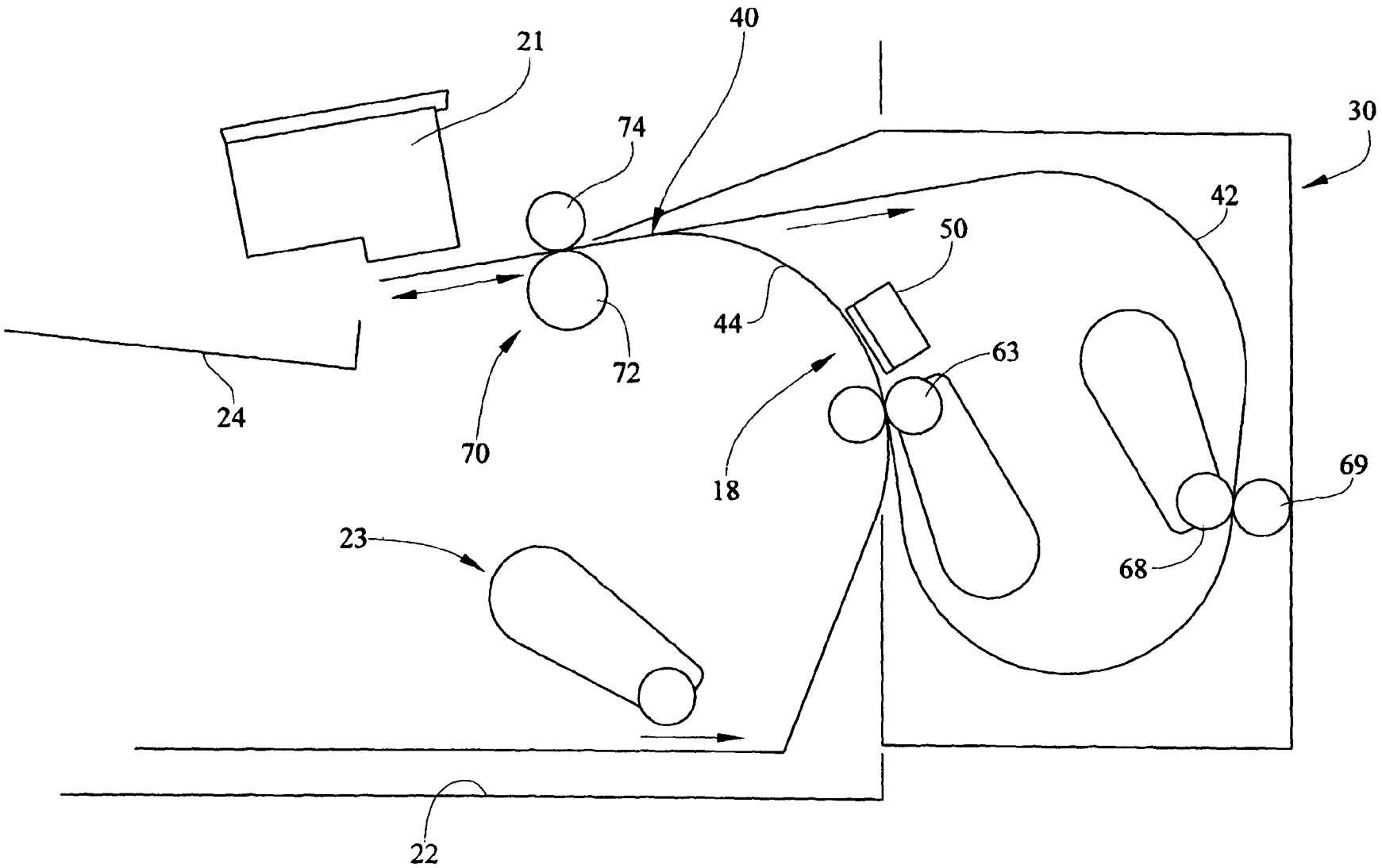
FIG. 5 is a side schematic view of the all-in-one device of FIG. 1.

The geartrain 60 is also depicted comprising two driving gears 62,64 and three transmission gears 65,66,67. The lower driving gear 62 is connected to a lower shaft extending through the inner frame 33. The upper driving gear 64 is connected to an upper shaft extending though the inner frame 33. One of the upper and lower gears 62,64 is rotated by a gear within the housing 20 of the all-in-one device 10. The gears engage one another when the duplexer module 30 is connected to the housing 20 of the all-in-one device 10. Subsequently, the transmission gears 65,66,67 and the other of the upper and lower gears 62,64 are rotated by the initial rotation of upper or lower gears 62,64 to feed media through the feedpath 42. The lower gear 62 and the lower shaft transmit rotational energy to a simplex feed driving roller 63 (FIG. 5). The upper gear 64 and upper shaft transmit rotational energy to a duplex feed driving roller 68 (FIG. 5). The transmission gears 65,66,67 transmit rotational energy from one of the lower and upper gear 62,64 to the other of the lower and upper gears 62,64 so that separate motors are not needed for each of the upper and lower shafts, according to the exemplary embodiment.

Referring now to FIG. 5, a side schematic view of the all-in-one device 10 is shown depicting the feedpath 40. The duplexing module 30 is positioned on the all-in-one device 10 so that the simplex and duplex feedpaths 44,42 are in feeding communication allowing both duplex printing and duplex scanning via feedpath 42. At the entrance to the feedpath 40, the input tray 22 comprises a pick mechanism 23. Various devices may be utilized to pick media from the input tray 22, including an auto-compensating mechanism as shown. This mechanism is known to one skilled in the art and therefore will not be described.

Along the simplex path 44 is a simplex driving feed roller 63 and an opposed idler forming a nip for receiving media from the input tray 22 or the recirculating path 42. Various driving roller designs may be utilized including the auto-compensating mechanism depicted. The simplex driving feed roller 63 receives media from the pick mechanism 23. The simplex driving feed roller 63 is driven by gear 62 (FIG. 4) and the interposed shaft. Along the duplexing path 42 is a duplexing feed driving roller 68 and opposed idler roller 69 forming a nip. The duplexing driving roller 68, depicted connected to an auto-compensating mechanism in the exemplary embodiment, is driven by gear 64 (FIG. 4) and interposed shaft. The duplex driving roller 68 receives the media moving through the duplexing feedpath 42 from a print feed mechanism 70 and directs the media to the scanbar 50 for duplex scanning before directing the media to the output tray 24.

Along the feedpath 40 is a print feed mechanism 70 comprising a print feed roller 72 and an idler 74 defining a nip therebetween. The print feed mechanism 70 receives simplex and duplex scanned and printed media and directs the media either to the output tray 24 or indexes the media through the print component 20. Alternatively, the print feed mechanism 70 may reverse and direct media through the duplex feedpath 42 after a simplex print or scan process. Downstream from the print feed mechanism 70 is the printing component 21 which may comprise various forms, as previously described.

As previously discussed, the duplexing ADF module 30 may be added to an all-in-one device 10 by rear attachment to the housing 20. Without the duplexing module 30 the all-in-one device comprises a flatbed scanning function and simplex printing function. This may be preferable for sale as a lower cost product. In such an embodiment, duplex printing may only be performed manually by reversing the media exiting the printing component 21 and placing the media into the input tray for the duplex pass by the printing component 21. However, the present exemplary embodiment provides the duplexing module 30 which maybe added to the all-in-one device 10 at a final assembly stage of production, depending on market forecasts, to convert a simplex printing system into a duplex printing and duplex auto-document feed scanning system. When the duplexing module 30 is added, the duplex path 42 communicates with the simplex printing path 44 within the all-in-one device 10 to provide the duplexing function and auto-document feed scanning (FIG. 2).

In operation, the user must select a printing or scanning process from, for instance, the control panel 11 (FIG. 1) or a connected PC. If the user selects a printing process and print media is loaded into input tray 22, the pick mechanism 23 picks an uppermost sheet from the print media stack and directs the media into the simplex path 44. Within the simplex path 44, the simplex driving feed roller 63 further directs the print media past the scanbar 50. After passing the scanbar 50, the media is directed to the print feed mechanism 70 where it is indexed through the printing component 21. After printing on a first side is completed, the media is either directed to the output tray 24 or reversed for duplex printing. When the media is reversed by the print feed mechanism 70 into the duplexing path 42, the trailing edge becomes the leading edge. By moving through the duplexing path 42, the media is returned to the print feed mechanism 70. Next, the media is indexed through the printing component 21 with the second side oriented toward the print component 21.

Alternatively, the user may select a scanning function. The user must position the target media in the input tray 22 before the pick mechanism begins picking the uppermost media into the simplex path 44. If the user subsequently intends to print copies of the scanned images, the print media must be positioned in the input tray 22 beneath the target media. Accordingly, the user may need to input the number of pages to scan, the type of scan, e.g. simplex or duplex, and the type of printing to perform, such as simplex or duplex, not necessarily in that order.

During the scanning process the target document is picked from the input tray 22 by the pick mechanism 23 and directed to the simplex driving feed roller 63. The simplex driving feed roller 63 indexes the media past the scanbar 50 where image scan data is acquired before moving to the print feed mechanism 70. The print feed mechanism 70 further directs the target media toward the output tray 24 until the trailing edge of the media is positioned in the nip of the print feed mechanism 70. In the case of a simplex scan, the media is directed to the exit tray 24. If the media is a double-sided target document, the media may be directed through the duplexing path 42 for duplex scanning at scanbar 50 prior to output at the output tray 24. In this situation, the trailing edge of the media is within the print feed mechanism 70 and the target media has cleared the scanbar 50. The print feed mechanism 70 reverses rotation and directs the media from the simplex path 44 to the duplex path 42. The gravity gate defined by the guides 38 is curved and normally pivoted to direct the media to the duplex path 42 so that the media moves through the duplexing module 30. The leading edge of the target media is directed toward the duplex driving feed roller 68 which continues to direct the media to the simplex driving feed roller 63. As the target media moves around the duplexing path 42 and toward the simplex path 44, the side of the target media oriented toward the scanbar 50 is reversed so that the second side is exposed to the scanbar 50. As the leading edge of the target media moves through the simplex driving feed roller 63, the media is indexed past the scanbar 50 for scanning of second side of the target media and further along through the simplex path 44 to the print feed mechanism 70 and subsequently directed to the output tray 24. As each of the target media sheets are scanned at the scanbar 50, the target images are stored in onboard memory within the all-in-one device 10.

In the case where copies of the scanned images are desired, after each of the target media sheets have been scanned, in either duplex or simplex mode, the pick mechanism 23 picks print media from the input tray 22. The print media is directed by the pick mechanism 23 upwardly through the simplex driving feed roller 63 through the simplex path 44 and to the print feed mechanism 70. The print feed mechanism roller 72 indexes the media past the print component 21 where scanned images from the first side of the first target media sheet are transferred to the print media. As the trailing edge of the print media reaches the print feed mechanism 70 and the last portions of the image data are transferred from the print component 21 to the print media, the print feed mechanism roller 72 reverses direction. The trailing edge of the print media then becomes the leading edge as the print media is directed through the duplexing path 42 within the duplexing module 30. The print media is directed through the duplexing driving feed roller 68 and the simplex driving feed roll 63 so that a second side of the print media is directed toward the print component 21. Specifically, the leading edge moves into the print feed mechanism 70 and is indexed past the print component 20 toward the output tray 24. After the first print media is directed through the simplex and duplex paths 44, 42, subsequent print media sheets are fed through the system corresponding to the number of target media sheets and the selections made on the control panel, or via computer connected to the all-in-one device 10. Specifically, print media sheets are directed through the system pertaining to the number of target media sheets and sides scanned into memory in the all-in-one device 10. As previously indicated, with only a single input tray 22 and output tray 24, the input tray 22 must be utilized to retain both print media and target media for scanning when a copy process is performed. According to an alternative embodiment, the printing may be performed by scanning a first document then printing the first document, scanning the second document and printing the second document, and so on. Such implementation would require less memory than a process wherein all the documents are scanned and subsequently all the documents are printed, since the memory cache is cleared after each document is printed.

Figure 6:
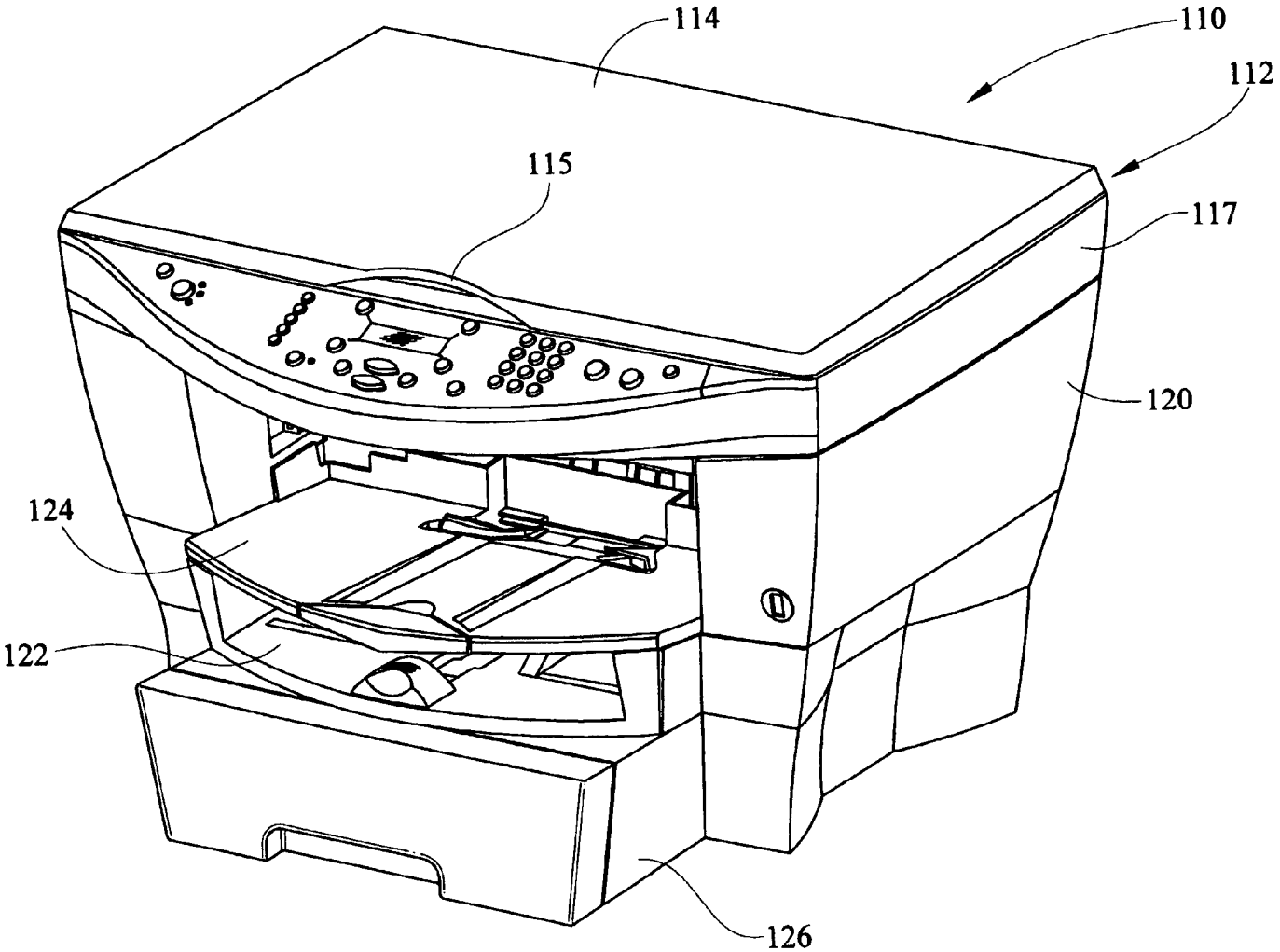
FIG. 6 is a front perspective view of an alternative embodiment of an all-in-one device including a secondary input tray.

Referring now to FIG. 6, an alternative all-in-one device 110 is depicted. The all-in-one device 110 comprises a flatbed scanning portion 112 having a scanner bed 117 and a lid 114 hingedly attached to the scanner bed 117. The lid 114 comprises a handle 115 for lifting the lid and providing a user access to the flatbed portion of the scanner. The all-in-one device 110 further comprises a printing component generally disposed within the housing 120. The all-in-one device 110 further comprises three media trays depicted from top to bottom as an exit tray 124, a first input tray 122 and a second input tray 126. The first input tray 122 and second input tray 126 may be utilized to retain stacks of print media, for printing or reproducing copies, and target media for feeding through an auto-document feeder. According to this alternative embodiment, the tray configuration provides separate trays for the print media input and target media input. In still a further alternative embodiment, one skilled in the art will recognize that various tray configurations may be provided including one input tray and two output trays for scanned media and printed media, or multiple modular input trays and modular output trays for target media and printed media or copies.

Figure 7:
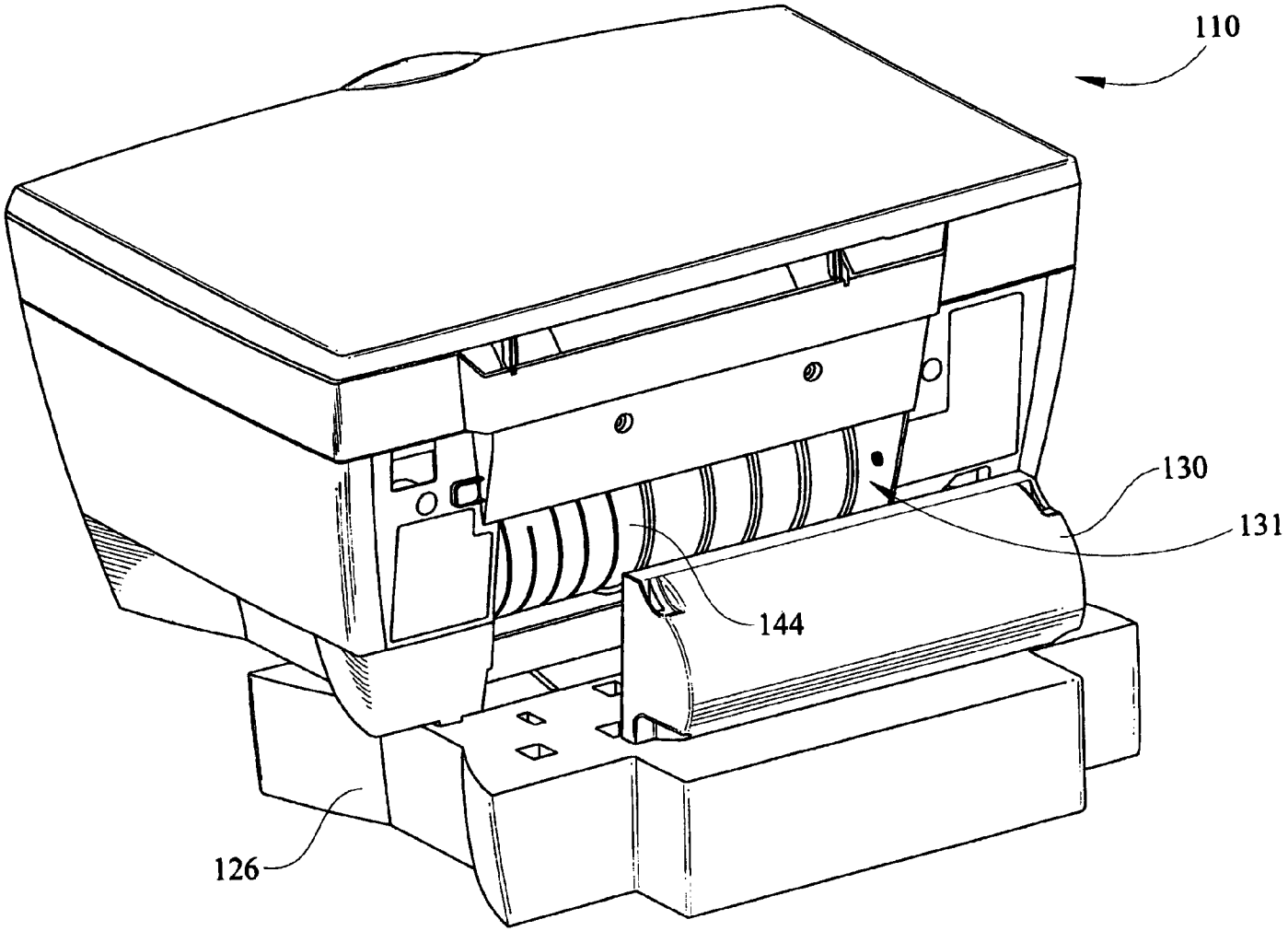
FIG. 7 is a rear partially exploded perspective view of the alternative embodiment of FIG. 6.

Referring to FIG. 7, the rear of the alternative embodiment is depicted in a partially exploded perspective view. Adjacent the all-in-one device 110 is a duplexing module 130 which slides into a receiving area 131 of the all-in-one device 110 during manufacture, preferably at a final stage of assembly. Since the module may be added at a final stage assembly process, the choice of assembling a duplexing ADF scanner and duplexing printer may depend upon market forecasts for such duplex ADF scanner and duplex printing devices. The duplexing module 130 slides into feeding communication with a simplex path 144. Beneath the all-in-one device 110 is a secondary input tray 126 which may retain print media or target media for scanning or copying, depending on the other input tray 122. The secondary input tray 126 may be and is depicted as an integral component with the duplexing module 130. However, alternate embodiments may include separate tray and module portions which maintain the feeding communication, described further herein, once installed. If the secondary tray 126 and duplexing module 130 is a one-piece unit, the unit may slide into position at the rear of the all-in-one device 110. If the unit is instead two pieces, the duplexing module 130 may slide into position at the rear of the all-in-one device 110 while the all-in-one device 110 is seated on the secondary tray 126.

Figure 8:
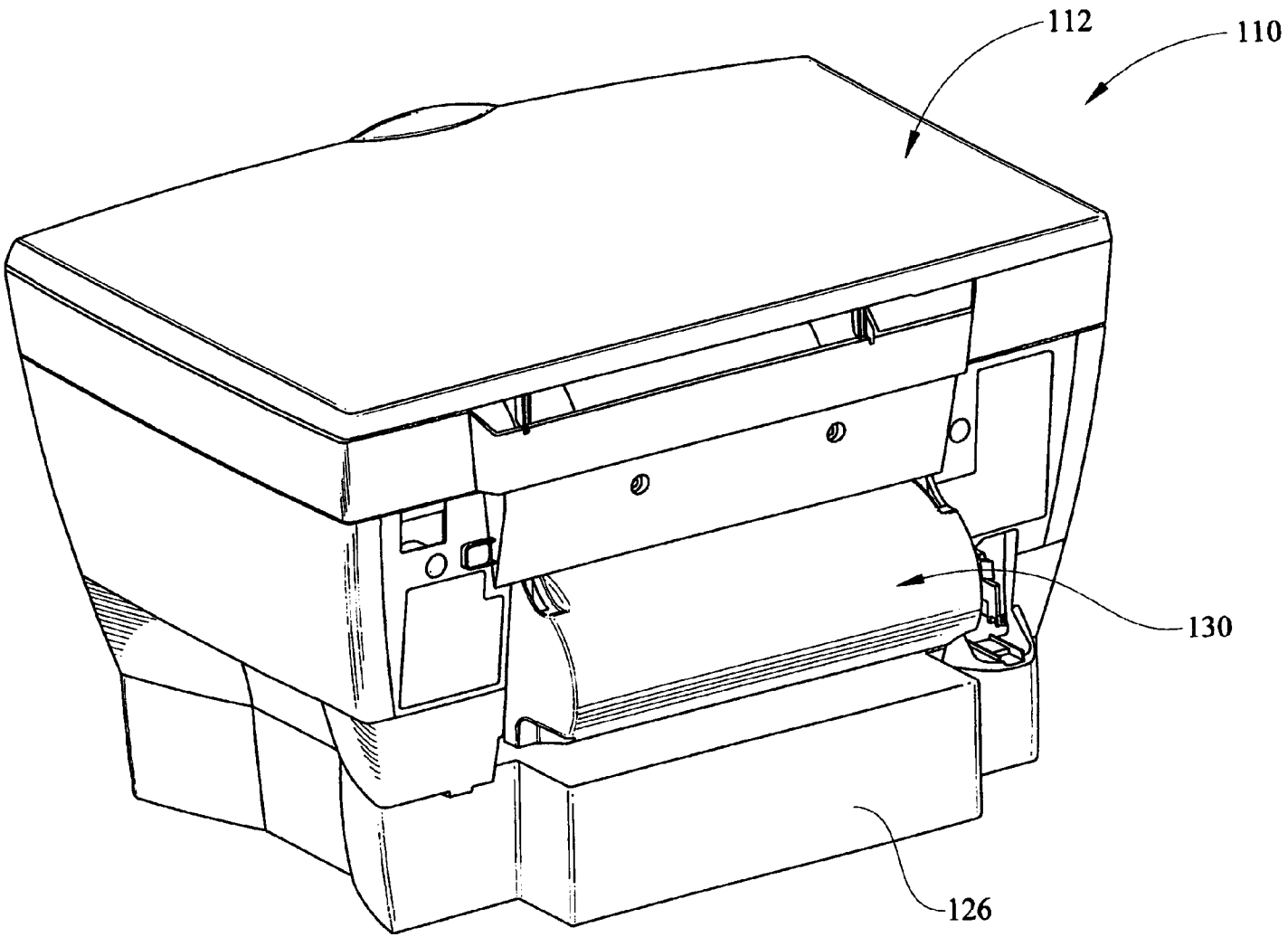
FIG. 8 is a rear perspective view of the assembled all-in-one device.

Referring now to FIG. 8, a rear perspective view of the alternative all-in-one device 110 is depicted after assembly. Extending from the rear surface of the all-in-one device 110 is the duplexing module 130. Beneath the duplexing module 130 is the second input tray 126 defining the alternative embodiment of the present invention. As previously indicated, the duplexing module 130 may be added at a final stage assembly to convert a simplex all-in-one device to a duplex and auto-document feed scanning device 110. The duplexing module 130 includes an auto-document feed scanner 118 (FIG. 8). According to one embodiment, both of the duplexing module 130 and a secondary tray 126 may be slideably connected to the all-in-one device 110 in order to convert a simplex all-in-one device to a duplex ADF printing and scanning all-in-one device 110.

Figure 9:
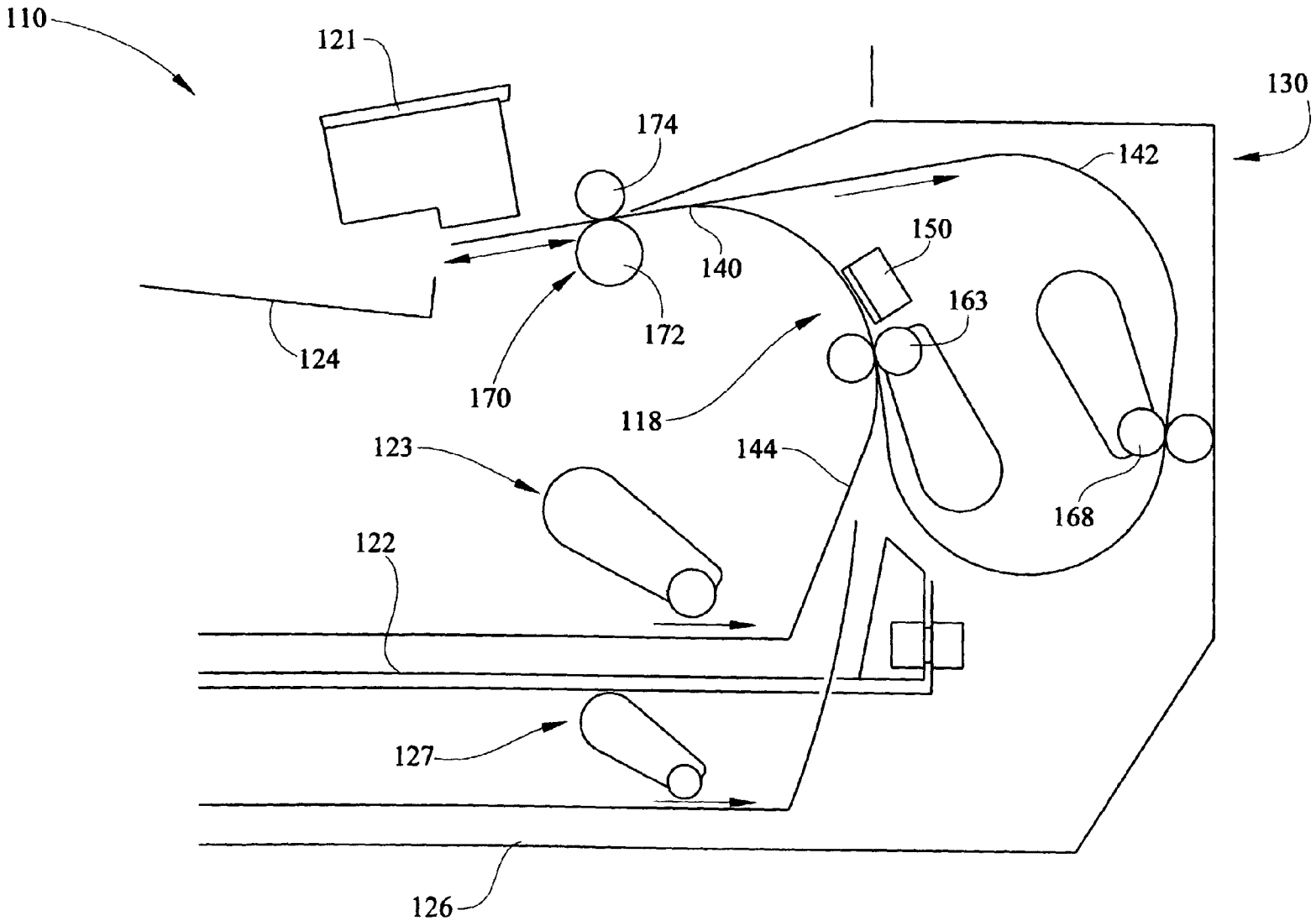
FIG. 9 is a side schematic view of the all-in-one device of FIG. 6.

Referring now to FIG. 9, a side schematic view of the all-in-one device 110 is depicted having the exit tray 124 and first and second input trays 122, 126. As shown, the first input tray 122 is disposed above the second input tray 126. The duplexing module 130 includes the second input tray 126 for connection to the housing of the all-in-one device 110 at a final stage assembly process. The all-in-one device 110 further comprises a feedpath 140 comprising a duplexing or recirculation path 142 and a simplex path 144. At an entrance to the path 140 is an input or pick mechanism 123. The pick mechanism 123 directs media into the feedpath 140. Likewise, the second input tray 126 also comprises a pick mechanism 127 for directing media into the feedpath 140. Along the simplex path 144 is a simplex driving feed roller 163 which directs media across the scanbar 150. Along the duplexing path 142 is a duplex driving feed roller 168 which directs media around the duplexing path 142. Between the recirculation loop 142 and the printing component 121 is a print feed mechanism 170 comprising a print feed driving roller 172 and an adjacent idler 174 defining a nip. The print feed mechanism 170 directs media into the recirculation loop for duplex scanning and printing or directs the media to pass the printing component 121 and onto the exit tray 124.

In operation print media is loaded into one of the first input tray 122 and second input tray 126. When a user selects a print function, the print media is picked by either the pick mechanism 123 or mechanism 127 and is directed into the simplex path 144. The simplex driving feed roller 163 directs the media to the print feed mechanism 170 which indexes the media past the printing component 121 in order to deposit indicia on a first side of the media. If the user has selected a simplex printing process, the media is ejected from the print feed mechanism 170 to the output tray 124. Alternatively, if the user has selected a duplex printing operation, the print feed mechanism 170 is reversed with the media trailing edge located in the nip defined between the print feed drive roller 172 and idler roller 174. As the media reverses, the trailing edge becomes the leading edge and the media moves through the duplexing path 142. Within the duplexing path 142, the media is advanced through the duplex drive feed roller 168 and the simplex driving feed roller 163 to the print feed mechanism 170. At this position, the print media is oriented with the second side facing the print component 121 and the print media is advanced past the print component 121 to perform the duplex printing before the media is advanced into the output tray 124.

Alternatively, a user may select a scanning process which may or may not include copying. When the media is scanned, the target documents are disposed in one of the first or second input trays 122, 126. Depending on whether the user is simplex or duplex scanning, the target media is fed through the feedpath 140, specifically through the simplex path 144, and indexed past the scanbar 150 for ADF scanning. If the target media is being simplex scanned, the target media is directed from the print feed mechanism 170 to the output tray 124. Alternatively, if the target media is duplex scanned, the print feed mechanism 170 reverses, which converts the trailing edge of the target media into the leading edge. The target media is directed through the duplex path 142 and indexed past the scanbar 150 a second time with the media rotated such that the second side is facing the scanbar 150 for duplex scanning. The media is then directed out the feedpath 140 to the output tray 124 before a second document is directed into the feedpath 140. One of ordinary skill in the art will realize that the first input tray and second input tray may be utilized to hold a stack of target media or print media so that both types are not placed in a single tray as with the first exemplary embodiment. If a copy process is desired, the other of the input trays direct media into the feedpath for printing of image scan data in either simplex or duplex mode, as previously described and utilizing the other input tray of trays 122,126 holding the print media.

Further, one of ordinary skill in the art may realize that in either the all-in-one device 10 or the all-in-one device 110, an additional step may be required wherein the print media or target media, when duplexed, may require a third pass through the recirculation path 42,142 in order to properly collate the media in the output tray 24.

According to the alternative embodiment comprising two output trays, one output tray may be utilized to receive target media and the second output tray may be utilized to receive printed and/or copied target media. In this embodiment, the operation may be altered to scan a target document and print the corresponding copy followed by scanning of the second target document and printing of that corresponding copy until the entire target media stack is scanned and copied. As opposed to the prior embodiment which scanned all documents before printing all of the copies, this embodiment would require less on-board memory since the memory cache may be cleared after each copy document is printed. Thus, such embodiment would result in decreased costs for manufacturing and decreased consumer costs.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A modular duplexing unit for an all-in-one device having a primary housing, a printing component, a manually-fed scanner, a media input tray and a simplex feedpath within said primary housing, comprising:

a duplexing module connectable to a side of said primary housing, said duplexing module having an enclosed duplex feedpath in feeding communication with the simplex feedpath when connected and a scanner mounted adjacent said enclosed duplex feedpath wherein said all-in-one device function is converted from simplex printing and manual scanning to duplex printing and duplex auto-document feed scanning using media and documents, respectively, fed from said media input tray of said all-in-one device.

2. The modular duplexing unit of claim 1, said duplexing feedpath in feeding communication with said simplex feedpath.

3. The modular duplexing unit of claim 1, said duplexing module having a geartrain.

4. The modular duplexing unit of claim 3, said geartrain engaging a gear in said all-in-one device.

5. The modular duplexing unit of claim 1, further comprising an electronic connector for electrical communication with said primary housing.

6. The modular duplexing unit of claim 2, said all-in-one device further comprising an output tray in feeding communication with said simplex and duplex feedpaths.

7. The modular duplexing unit of claim 6, further comprising a secondary input tray connected to said duplexing module.

8. A modular duplexing feedpath unit including auto-document feed scanner for an all-in-one device having a primary housing, a printing component, a manually-fed flat bed scanner, a media input tray for supporting media for printing and a printing feedpath within said primary housing, comprising:

a duplexing auto-document feed scanner housing for connection with a side of the primary housing;

an enclosed duplexing feedpath defined within said duplexing auto-document feed scanner housing, said enclosed duplexing feedpath being in feeding communication with said printing component and said printing feedpath within said primary housing of said all-in-one device when said duplexing auto-document feed scanner housing is connected;

a single image sensor positioned in said duplexing auto-document feed scanner housing along said enclosed duplexing feedpath, said image sensor positioned to perform duplex auto-document feed scanning on a document fed from said media input tray;

at least one gear in said duplexing auto-document feed scanner housing meshing with at least one gear in said primary housing; and an electrical connector in said duplexing auto-document feed scanner housing in electrical communication with an electrical connector in said primary housing.

9. The modular duplexing feedpath unit of claim 8, wherein said printing feedpath is a substantially C-shaped feedpath.

10. The modular duplexing feedpath unit of claim 8, said duplexing feedpath further comprising a recirculation path.

11. The modular duplexing feedpath unit of claim 8, said single image sensor comprising a contact image sensor.

12. The modular duplexing unit of claim 9 wherein said image sensor is disposed along an inner surface of said feedpath.

13. The modular duplexing feedpath unit of claim 8, said side of said primary housing further comprising a rear side having an aperture therein for removably attaching said duplexing auto-document feed scanner housing.

14. The modular duplexing feedpath unit of claim 8, said duplexing auto-document feed scanner housing including a media tray.

15. A modular duplexing unit for use with an all-in-one device having a printing component, a primary housing with a receiving area, a media input tray for supporting media for printing and a printing feedpath in said primary housing, the modular duplexing unit comprising:

a modular housing connectable to a side of said primary housing through said receiving area; said modular housing having an enclosed duplexing feedpath; and a single image sensor disposed along said enclosed duplexing feedpath and in optical communication with said enclosed duplexing feedpath, said single image sensor positioned to perform duplex auto-document feed scanning on a document fed from said media input tray;

wherein said enclosed duplexing feedpath is in communication with said printing feedpath when said modular housing is connected through said receiving area.

16. The modular duplexing housing of claim 15 further comprising a media stacking tray for providing documents to said duplexing feedpath.

17. The modular duplexing unit of claim 15 further comprising a secondary input tray in feeding communication with at least one of said simplex feedpath and said duplex feedpath.

18. The modular duplexing unit of claim 15 wherein said at least one input tray comprises first and second input trays for placement of print media and target media, respectively.

* * * * *